US005735181A

United States Patent [19]

Anderson

[11] Patent Number: 5,735,181

[45] Date of Patent: Apr. 7, 1998

[54] APPARATUS FOR REMOVING A SAFETY CAP FROM A SAFETY CONTAINER

[76] Inventor: Arthur G. Anderson, 5142 N. Monitor Ave., Chicago, Ill. 60630

[21] Appl. No.: 611,219

[22] Filed: Mar. 5, 1996

[51] Int. Cl.[6] ..... B67B 7/00

[52] U.S. Cl. ..... 81/3.25; 81/3.4; 81/3.07

[58] Field of Search ..... 81/3.25, 3.4, 3.07

[56] References Cited

U.S. PATENT DOCUMENTS

| | | | |
|---|---|---|---|
| 3,097,756 | 7/1963 | Dorsey | 215/9 |
| 3,276,612 | 10/1966 | Caldwell | 215/9 |
| 3,583,263 | 6/1971 | Herigstad | 81/3.4 |
| 3,600,982 | 8/1971 | Tholen | 81/3.4 |
| 3,604,290 | 9/1971 | Waite | 81/3.4 |
| 3,827,592 | 8/1974 | Deussen | 215/9 |
| 3,828,959 | 8/1974 | Lerner | 215/9 |
| 4,165,018 | 8/1979 | Giggard | 220/284 |
| 4,278,178 | 7/1981 | Geiser | 215/215 |
| 4,355,729 | 10/1982 | Maguire | 215/215 |
| 4,731,512 | 3/1988 | Barriac | 215/220 |
| 4,760,763 | 8/1988 | Trick et al. | 81/3.4 |
| 5,114,029 | 5/1992 | Gibilisco | 215/220 |

FOREIGN PATENT DOCUMENTS

| | | | |
|---|---|---|---|
| 808 | of 1893 | United Kingdom | 81/3.25 |
| 17938 | of 1908 | United Kingdom | 81/3.4 |

*Primary Examiner*—James G. Smith
*Assistant Examiner*—Joni B. Danganan
*Attorney, Agent, or Firm*—Wallenstein & Wagner, Ltd.

[57] ABSTRACT

An apparatus for removing a safety cap from a safety container is provided for a prescription bottle or other safety container system. A tapered surface wedgingly engages the periphery of the safety cap when pressed into pressure engagement with the tapered surface. The tapered surface includes prongs for guiding the safety cap into pressure engagement with the tapered surface. A suction cup is disposed on the tapered surface for detaching the safety cap from the safety container.

18 Claims, 2 Drawing Sheets

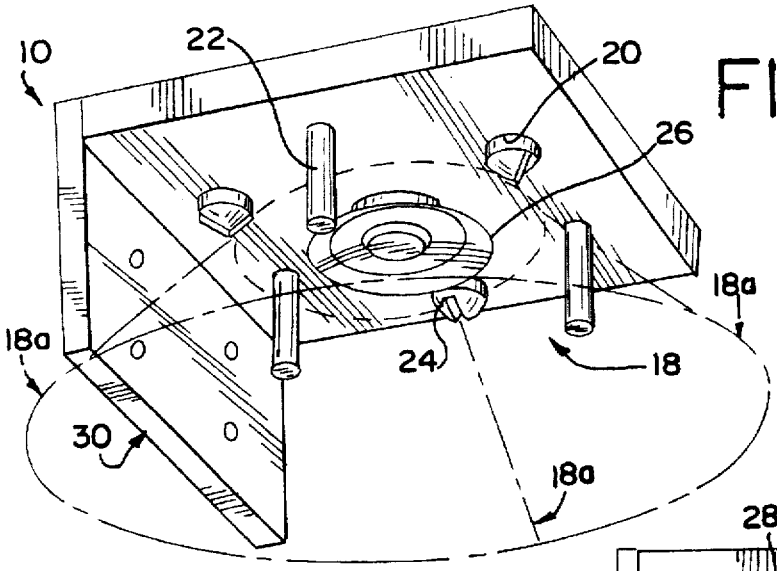
FIG. 1
FIG. 3
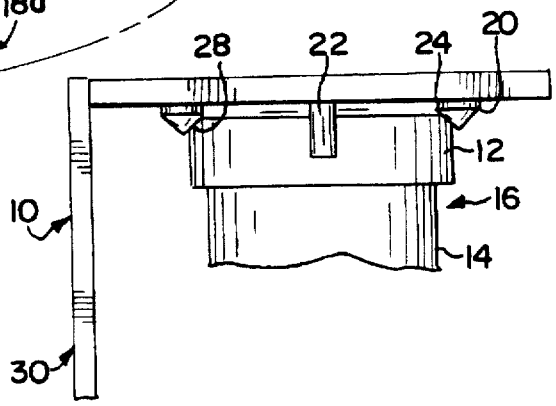
FIG. 2
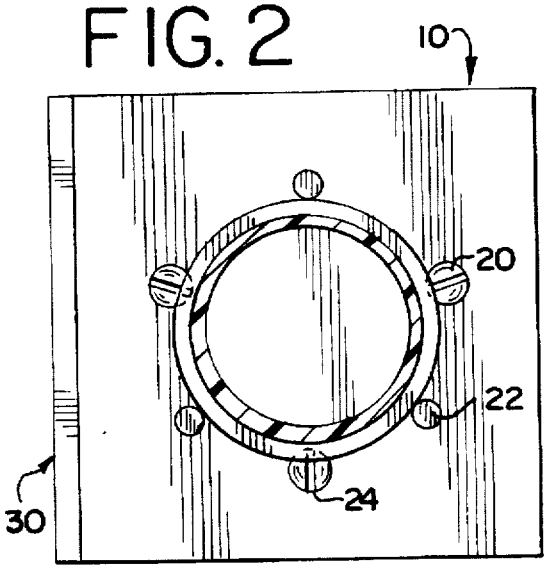
FIG. 4
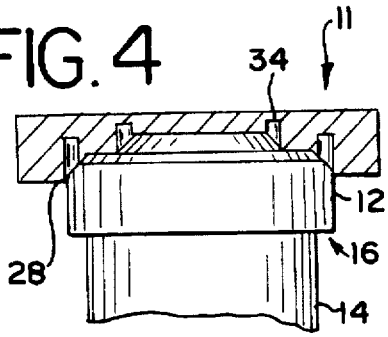
FIG. 5
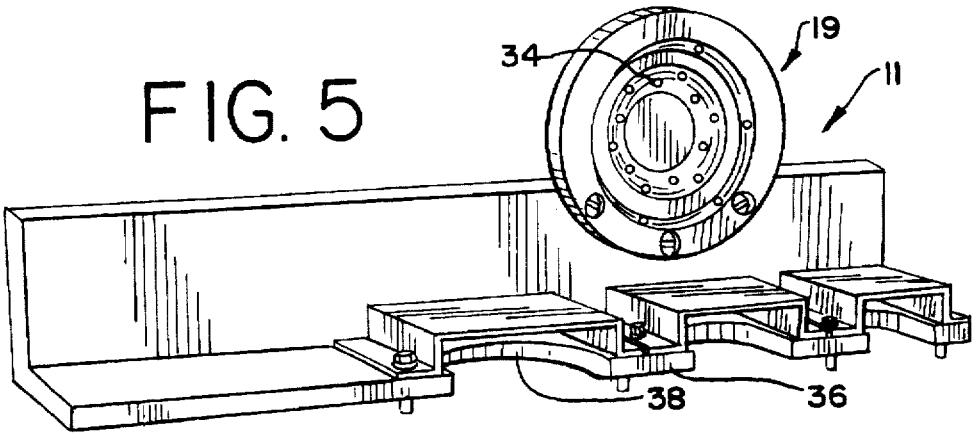

APPARATUS FOR REMOVING A SAFETY CAP FROM A SAFETY CONTAINER

TECHNICAL FIELD

The present invention generally relates to an apparatus for removing a safety cap from a safety container, such as a prescription bottle.

BACKGROUND OF THE INVENTION

Devices to effect removal of a safety cap, also known as a child-resistant cap, from a safety container system, such as a prescription bottle, are generally known in the art. A typical device such as the device disclosed in U.S. Pat. No. 3,097,756, provides a number of different embodiments for removing a safety cap from a safety container involving a tool such as a coin, pin or key to facilitate opening. In each embodiment, an inner cap and an outer shell member are arranged to move in unison when the tool is properly employed allowing removal of the cap. However, the embodiments disclosed facilitate the opening of a specific safety closure system disclosed in U.S. Pat. No. 2,921,705, not a safety container system generally known in the art. Safety container systems, generally known in the art and utilized with the present invention, involve a safety cap which is operatively engaged with a safety container requiring downward force on the safety cap while rotating the safety container to remove the safety cap. Such safety container systems are commonly used as child safety devices for prescription medicines.

Another device which removes a safety cap from a safety container is disclosed in U.S. Pat. No. 3,827,592, involving a cover which fits onto the neck of the container and a key which detachably fits onto the cover of a container. The key is designed to engage with the cover allowing the cover to be opened by applying downward pressure and rotating. Some other examples of devices for facilitating the removal of safety caps from safety containers are shown in U.S. Pat. Nos. 3,276,612, 3,828,959, 4,165,018, 4,278,178, 4,355,729, 4,731,512, and 5,114,029. These devices typically involve tools which facilitate the opening of a safety cap from a safety container. However, the tools disclosed in the prior art are not designed to be used with safety container systems generally known in the art as used with the present invention.

Further, none of the above-mentioned devices effectively eliminate the necessity of pressing down on the safety cap to effect opening. The present invention allows a person, having one-handed mobility to remove the safety cap from a safety container because the necessity of applying downward pressure with one's hand is eliminated. A physically weak person such as an elderly or arthritic person, may easily remove a safety cap from a safety container by utilizing the present invention. The present invention requires the application of little physical force and only one hand is needed. Moreover, the present invention is designed to be used with safety container systems generally known in the art.

SUMMARY OF THE INVENTION

It is an object of the present invention to provide an apparatus for removing a safety cap from a safety container, such as a prescription bottle. The apparatus can be utilized with one hand and the necessity of pressing down on the safety cap is eliminated.

An aspect of the present invention is a plurality of spaced hemispherical members each hemispherical member having a tapered or curved surface that together define a cone-shaped surface adapted to wedgingly engage an outer periphery of the safety cap. The hemispherical members comprise a groove having edges to grasp the outer periphery of the safety cape to provide resistance to rotation of the safety cap when pressed into pressure engagement with the cone-shaped surface. The grooves having edges is positioned on the spaced hemispherical members such as to contact the outer periphery of the safety cap.

The hemispherical members are preferably positioned symmetrically about a suction cup. The suction cup detaches the safety cap from the safety container after the safety cap is pressed into pressure engagement with the cone-shaped surface. The cone-shaped surface also includes prongs for guiding the safety cap into pressure engagement with the cone-shaped surface. The apparatus for removing a safety cap from a safety container may be mounted to the wall or other object which provides stability to the apparatus while operating the apparatus.

In a second embodiment of the present invention, the cone-shaped surface is generally frustoconical and adapted to receive a safety cap of a variety of circumferences. The cone-shaped surface containing a plurality of openings which are positioned such that portions of the cone-shaped surface adjacent the openings are adapted to contact the outer periphery of the safety cap. A shelf defined by at least one semicircular ridge is provided to detach the safety cap from the safety container.

In a third embodiment of the present invention, the cone-shaped surface comprises hemispherical members arranged in concentric rings so as to provide a cone-shaped surface adapted to receive safety caps of a variety of circumferences. The cone-shaped surface also includes an encased spring outwardly biasing the suction cup away from the cone-shaped surface.

Other features and advantages of the invention will be apparent from the following specification taken in conjunction with the following drawings.

BRIEF DESCRIPTION OF THE DRAWINGS

FIG. 1 is a perspective view of an apparatus for removing a safety cap from a safety container according to the present invention;

FIG. 2 is a, bottom view of the apparatus of FIG. 1;

FIG. 3 is a side view of the apparatus of FIG. 1;

FIG. 4 is a sectional view of a second embodiment of the present invention;

FIG. 5 is a perspective view of the apparatus of FIG. 4;

DETAILED DESCRIPTION

Figure 6:
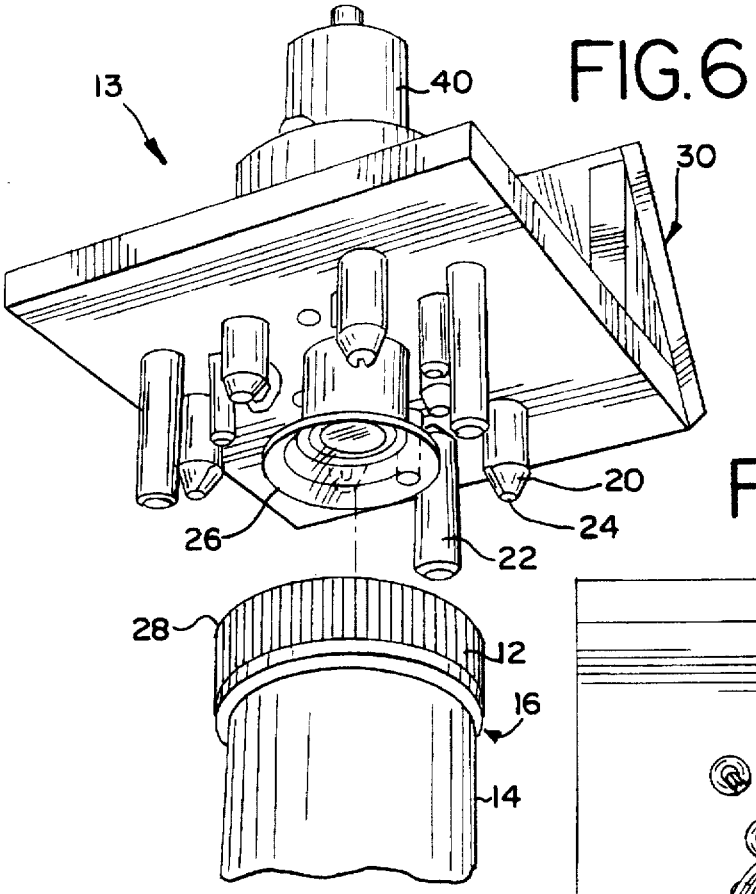
FIG. 6 is a perspective view of a third embodiment of the present invention.

While this invention is susceptible to embodiments in many different forms, there is shown in the drawings and will herein be described in detail, preferred embodiments of the invention with the understanding that the present disclosure is to be considered as an exemplification of the principle of the invention and is not intended to limit the broad aspects of the invention to the embodiments illustrated.

As shown generally in FIGS. 1–3, an apparatus, designated 10, for removing a safety cap 12 from a safety container 14 in a safety container system 16, comprising a cone-shaped surface 18, illustrated by dotted lines 18*a*, having a plurality of hemispherical members 20 disposed thereon. Each hemispherical member having a tapered or curved surface that together define the cone-shaped surface. The dotted lines 18*a* collectively define the cone-shaped surface 18. The apparatus 10 is molded of a strong synthetic resin, such as plastic or nylon. However, other materials could be substituted for different applications, as is known in the art.

Prongs 22 are positioned on the cone-shaped surface 18 for guiding the safety cap 12 into pressure engagement with the cone-shaped surface 18. The hemispherical members 20 include a groove 24 having edges on either side of the groove 24 which assist the hemispherical members 20 in grasping the outer periphery of the safety cap for creating resistance to the rotation of the safety cap 12 while the safety cap 12 is pressed into pressure engagement with the cone-shaped surface 18. The hemispherical members 20 are preferably positioned symmetrically about a suction cup 26. When the safety cap 12 is wedgingly guided into pressure engagement within the cone-shaped surface 18 and rotated, the suction cup 12 detaches the safety cap 12 from the safety container 14. The user may then retrieve the contents from the safety container 14.

As illustrated in FIG. 3, the groove 24 having edges is positioned on the hemispherical members 20 such as to contact an outer periphery 28 of the safety cap 12. The hemispherical members 20 are typically conical shaped and comprise screw heads. However, many other textured elements known in the art, which are capable of creating resistance against the safety cap 12, may be substituted for hemispherical members 20 comprising a groove The apparatus 10 has an elongated portion 30 containing holes 32 for receiving screws allowing the apparatus 10 to be easily mounted to a wall. The apparatus 10 may also be mounted to another object which provides stability to the apparatus 10.

FIGS. 4 and 5 illustrate a second embodiment of the present invention, designated 11, having a cone-shaped surface 19 which is generally frustoconical and adapted to receive a safety cap 12 of a variety of circumferences. The cone-shaped surface 19 contains a plurality of openings 34. The openings 34 are positioned such that portions of the cone-shaped surface 19 adjacent the openings 34 are adapted to contact the outer periphery 28 of the safety cap 12. The openings 34 adjacent the cone-shaped surface 19 provide a textured surface creating resistance to the rotation of the safety cap 12 when pressed into pressure engagement with the cone-shaped surface 19. The apparatus 11 disclosed in FIG. 5 also includes a shelf 36 having at least one semicircular ridge 38 adapted to detach the safety cap 12 from the safety container 14.

Figure 7:
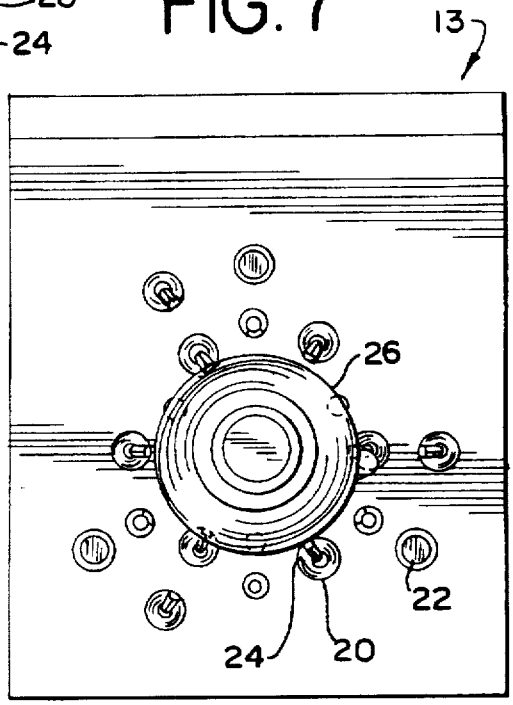
FIG. 7 is a bottom view of the apparatus of FIG. 6.
Figure 8:
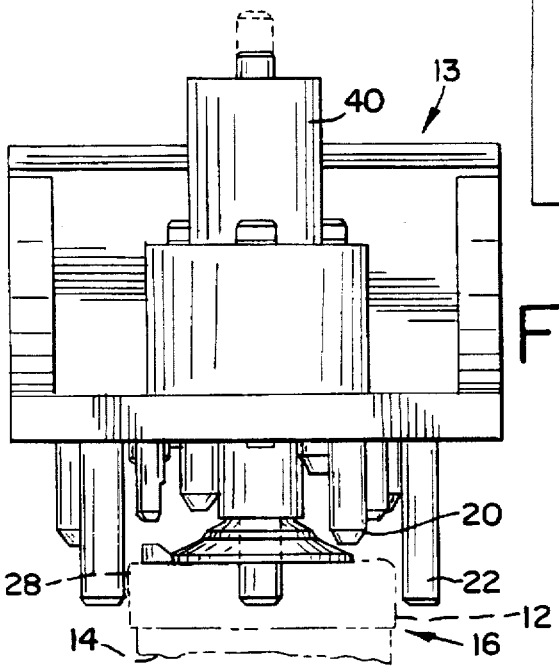
FIG. 8 is a side view of the apparatus of FIG. 6.

A third embodiment of the present invention is disclosed in FIGS. 6–8, generally designated 13. The apparatus 13 comprises spaced hemispherical members 20 arranged to form a plurality of concentric rings. The concentric ring arrangement of hemispherical members 20 creates a cone-shaped surface 18 adapted to receive a safety cap 12 of a variety of circumferences. Prongs 22 are positioned on the cone-shaped surface 18 so as to also form concentric rings for guiding a safety cap 12 of a variety of circumferences into pressure engagement with the cone-shaped surface 18. The apparatus 13 also includes an encased spring 40 for outwardly biasing the suction cup 26 away from the cone-shaped surface 18. The encased spring 40 allows the suction cup 26 to function with each concentric ring of hemispherical members 20 to detach a safety cap 12 of a variety of circumferences.

While the preferred embodiments of the invention have been described, various modifications and substitutions may be made without departing from the scope of the invention. Accordingly, it is to be understood that the invention has been described by way of illustration, and not limitation.

I claim:

1. For a container system comprising a safety container and a safety cap, an apparatus for releasing the safety cap from the safety container, the apparatus comprising:

means defining a cone-shaped surface, the means including a plurality of circumferentially disposed hemispherical members for wedgingly engaging the outer periphery of the safety cap, thereby providing resistance to rotation of the safety cap when the safety cap is pressed into pressure engagement with the hemispherical members and the safety container is rotated.

2. The apparatus of claim 1, wherein the spaced hemispherical members are equidistant from a center point on the cone-shaped surface.

3. The apparatus of claim 1, wherein the spaced hemispherical members are positioned symmetrically about a center point on the cone-shaped surface.

4. The apparatus of claim 1, wherein the spaced hemispherical members are arranged to form a plurality of concentric rings.

5. The apparatus of claim 1, wherein the spaced hemispherical members comprise screw heads.

6. The apparatus of claim 5, wherein the spaced hemispherical members comprise three screw heads.

7. The apparatus of claim 1, wherein the means defining a cone-shaped surface further comprises a groove disposed on one of the hemispherical members.

8. The apparatus of claim 1, wherein the means defining a cone-shaped surface further comprises a groove disposed on each of the hemispherical members.

9. The apparatus of claim 1, including means for detaching the safety cap from the safety container.

10. The apparatus of claim 9, wherein the detaching means is a suction cup.

11. The apparatus of claim 10, including means for outwardly biasing the suction cup away from the cone-shaped surface.

12. The apparatus of claim 9, wherein the detaching means is a shelf defined by at least one semicircular ridge.

13. The apparatus of claim 1, including elongated means for guiding the safety cap into pressure engagement with the means defining a cone-shaped surface.

14. The apparatus of claim 13, wherein the elongated means comprises prongs which further define the cone-shaped surface.

15. For a container system comprising a safety container and a safety cap, an apparatus for releasing the safety cap from the safety container, the apparatus comprising:

a plurality of spaced hemispherical members positioned as to define a cone-shaped surface for accepting a safety cap, the hemispherical members comprising a groove for wedgingly engaging an outer periphery of the safety cap and for providing resistance to rotation of the safety cap when pressed into pressure engagement with the plurality of hemispherical members.

16. For a container system comprising a safety container and a safety cap, a method for releasing the safety cap from the safety container, the method comprising the steps of:

providing a plurality of hemispherical members defining a cone-shaped surface for accepting a safety cap for applying resistance to rotation of the safety cap;

guiding the safety cap into engagement with the plurality of hemispherical members;

pressing the safety container into pressure engagement with the plurality of hemispherical members; and rotating the safety container.

17. The method of claim 16, wherein means defining a cone-shaped surface further comprises a groove disposed on the textured elements.

18. A method of claim 16, further comprising the step of:

detaching the safety cap from the safety container.

* * * * *